US009125445B1

(12) United States Patent
Bullock et al.

(10) Patent No.: US 9,125,445 B1
(45) Date of Patent: Sep. 8, 2015

(54) HAIR ACCESSORY AND ASSOCIATED USE THEREOF

(71) Applicants: Tammy Bullock, Orange, NJ (US); Randy Bullock, Orange, NJ (US)

(72) Inventors: Tammy Bullock, Orange, NJ (US); Randy Bullock, Orange, NJ (US)

( * ) Notice: Subject to any disclaimer, the term of this patent is extended or adjusted under 35 U.S.C. 154(b) by 0 days.

(21) Appl. No.: 14/249,325

(22) Filed: Apr. 9, 2014

Related U.S. Application Data

(60) Provisional application No. 61/809,966, filed on Apr. 9, 2013.

(51) Int. Cl.
*A41G 3/00* (2006.01)
*A41G 5/00* (2006.01)

(52) U.S. Cl.
CPC ..... *A41G 3/00* (2013.01); *A41G 5/0046* (2013.01); *A41G 5/00* (2013.01); *A41G 5/0073* (2013.01)

(58) Field of Classification Search
CPC ..... A41G 5/004; A41G 5/00; A41G 5/0013; A41G 5/0026; A41G 5/0073; A41G 5/0053
USPC ..... 132/53–56, 201, 57.1, 58
See application file for complete search history.

(56) References Cited

U.S. PATENT DOCUMENTS

| | | | | |
|---|---|---|---|---|
| 2,567,119 | A * | 9/1951 | Naidor | 2/200.1 |
| 2,651,310 | A * | 9/1953 | Selson | 132/274 |
| 3,280,826 | A * | 10/1966 | Jenkins | 132/201 |
| 3,474,798 | A * | 10/1969 | Tillotson | 132/53 |
| 3,724,470 | A * | 4/1973 | Wilson | 132/212 |
| 5,806,535 | A * | 9/1998 | Becker | 132/54 |
| 6,079,419 | A * | 6/2000 | Perlsweig | 132/60 |
| 6,830,054 | B1 * | 12/2004 | Ross-Kuehn | 132/201 |
| 7,854,233 | B2 * | 12/2010 | Freelove | 132/201 |
| 2008/0178902 | A1 * | 7/2008 | Moeszinger | 132/273 |
| 2008/0257369 | A1 * | 10/2008 | Poole | 132/53 |

* cited by examiner

*Primary Examiner* — Robyn Doan

(57) ABSTRACT

A hair extension for covering a bald region of a head of a user includes a wig having a hair portion, a resilient head band fixedly attached to the hair portion, and a fastener removably attached to the hair portion and adjustably mated to the head band. Notably, a portion of the head band as well as an entirety of the fastener each is seated beneath the hair portion and thereby not visible from an external line of sight directed to the hair portion.

2 Claims, 4 Drawing Sheets

HAIR ACCESSORY AND ASSOCIATED USE THEREOF

CROSS REFERENCE TO RELATED APPLICATIONS

This application claims the benefit of U.S. Provisional Application No. 61/809,966 filed Apr. 9, 2013, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

1. Technical Field

Exemplary embodiment(s) of the present disclosure relate to hair accessories and, more particularly, to a hair extension for providing an attractive way of styling hair and covering a bald portion on a head of a user.

2. Prior Art

Throughout history, men and women have worn hair extensions and hairpieces as a practical alternative to styling, or caring for, natural hair. In ancient Egypt, people from all classes shaved their heads in order to remain comfortable in the intense African heat, donning long black hair extensions for social and ceremonial events. These early hair extensions were made of everything from palm and wool fibers, to animal or human hair, and were adorned with gold, silver and lapis beads. In ancient Rome, long blonde hair extensions were worn by fashionable women during the reign Emperor Claudius.

In later cultures, hair extensions were worn mostly by women. However, after the French King Louis VIII began to wear elaborate hair pieces and hair extensions, the trend was once again embraced by men throughout Europe and in the "New World" of America. Today, hair extensions, hair pieces and extensions are worn for a variety of reasons. Whether a simple toupee worn by a man suffering premature baldness, a finely crafted hair extension worn by a woman who has lost her hair as a result of chemotherapy treatments or alopecia, or colorful hair extensions and braids which adorn the head of a pop star: hair extensions, hairpieces and extensions offer consumers a simple means of accentuating their appearance and feeling good about themselves.

Accordingly, a need remains for providing a hair extension in order to overcome at least one prior art shortcoming. The exemplary embodiment(s) satisfy such a need by providing a hair extension that is convenient and easy to use, lightweight yet durable in design, versatile in its applications, and designed for providing an attractive means of styling hair and covering a bald portion on a head of a user.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a hair extension for covering a bald region of a head of a user. These and other objects, features, and advantages of the non-limiting exemplary embodiment(s) are provided by the hair extension including a wig including a hair portion, a resilient head band fixedly attached to the hair portion, and a fastener removably attached to the hair portion and adjustably mated to the head band. Notably, a portion of the head band as well as an entirety of the fastener each is seated beneath the hair portion and thereby not visible from an external line of sight directed to the hair portion.

In a non-limiting exemplary embodiment, the hair portion includes an anterior section and a posterior section detachably engaged therewith.

In a non-limiting exemplary embodiment, the head band includes a single and unitary elastic loop connected to a front edge of the posterior section.

In a non-limiting exemplary embodiment, the fastener includes a comb slidably affixed to a longitudinal length of the elastic loop.

In a non-limiting exemplary embodiment, the comb is removably engaged with the anterior section.

In a non-limiting exemplary embodiment, a distal edge of the posterior section folds up and over the head band and the fastener, thereby extending downwardly away from the anterior section.

In a non-limiting exemplary embodiment, the head band further includes a decorative overlay positioned over an upper section of the elastic loop as well as the comb and the front edge of the posterior section.

In a non-limiting exemplary embodiment, the distal edge of the posterior section is raised above and overlaps a rear edge of the anterior section.

The present disclosure further includes a method of utilizing a hair extension for covering a bald region of a head of a user. Such a method includes the steps of: providing a wig by performing a plurality of sub-steps including: providing a hair portion; providing and fixedly attaching a resilient head band to the hair portion; providing and adjustably mating a fastener to the head band; removably attaching the fastener to the hair portion; seating a portion of the head band as well as an entirety of the fastener beneath the hair portion such that each of the portion of the head band as well as the entirety of the fastener are not visible from an external line of sight directed to the hair portion; and positioning the wig on the bald region of the head of the user.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

FIG. 1 is a perspective view of a hair accessory (extension) for covering a bald region of a head of a user, in accordance with a non-limiting exemplary embodiment;

FIG. 1*a* is an enlarged bottom plan view of section 1*a* identified in FIG. 1, showing the interrelationship between the comb, elastic loop, anterior section and posterior section of the hair portion;

Figures 1, 1A:
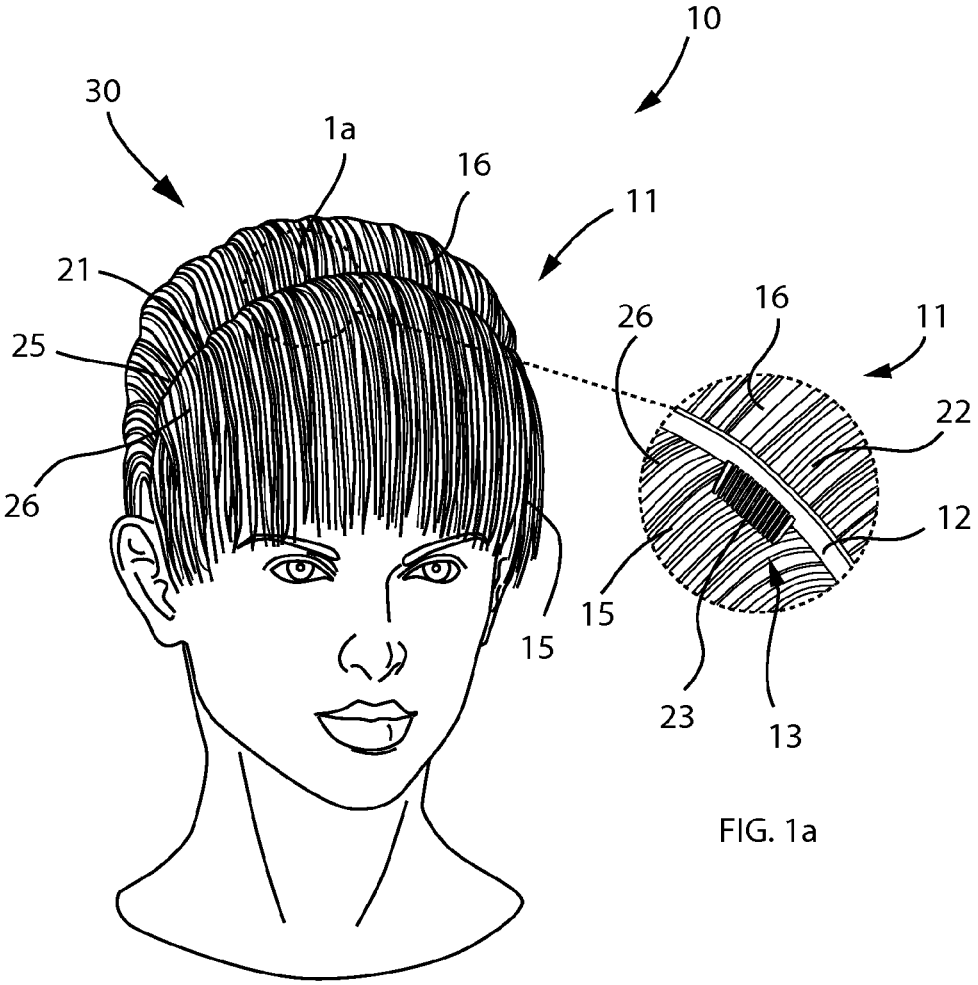

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

Figure 2:
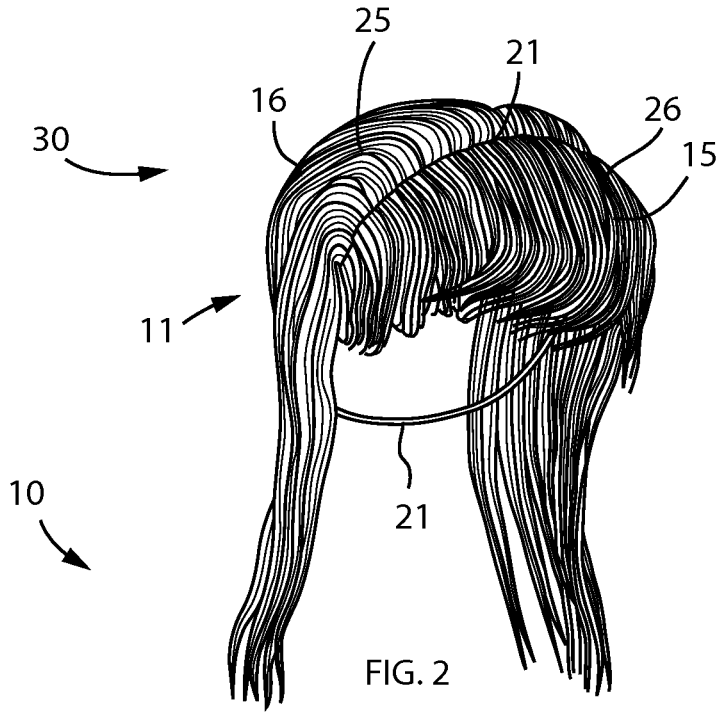
FIG. 2 is a front perspective view of a hair accessory (extension) for covering a bald region of a head of a user, in accordance with another non-limiting exemplary embodiment.
Figure 3:
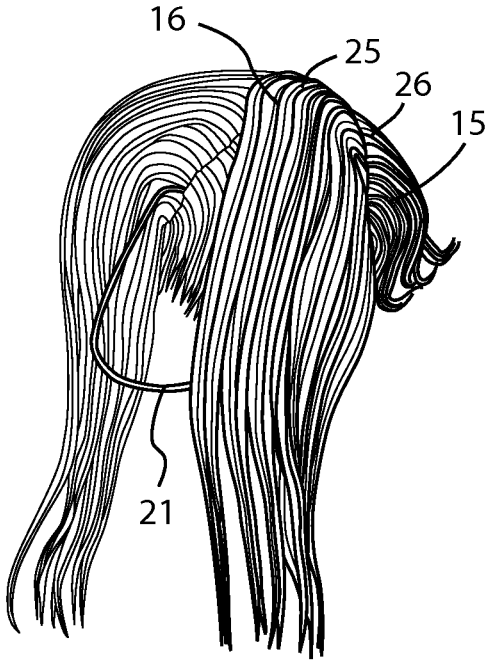
FIG. 3 is a rear perspective view of the hair accessory (extension) shown in FIG. 2.
Figure 4:
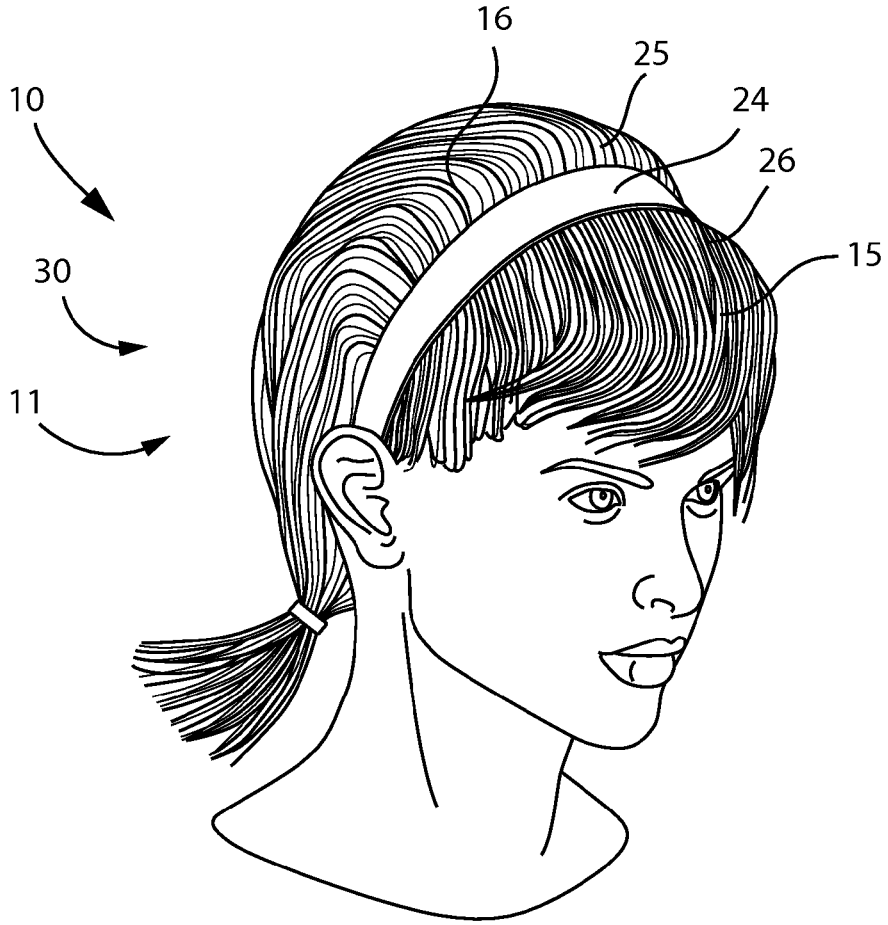
FIG. 4 is a perspective view of a hair accessory (extension) for covering a bald region of a head of a user, in accordance with yet another non-limiting exemplary embodiment.
Figure 5:
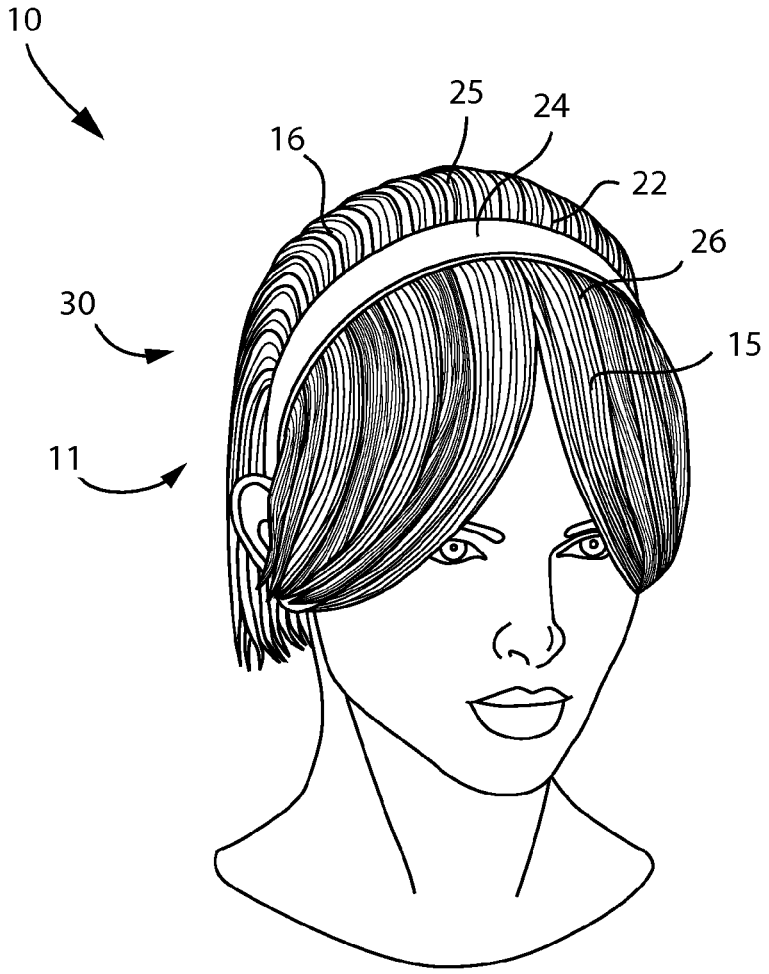
FIG. 5 is a perspective view of a hair accessory (extension) for covering a bald region of a head of a user, in accordance with yet another non-limiting exemplary embodiment.

The non-limiting exemplary embodiment(s) is/are referred to generally in FIGS. 1-5 and is/are intended to provide a hair extension 10 (also referred to as hair accessory) for providing an attractive means of styling hair. It should be understood that the exemplary embodiment may be used to stylize many different types of hair types, and should not be limited to any particular hair type described herein.

Referring to FIGS. 1-5, a hair extension 10 for covering a bald region of a head of a user includes a wig 30 having a hair portion 11, a resilient head band 12 fixedly attached to the hair portion 11, and a fastener 13 removably attached to the hair portion 11 and adjustably mated to the head band 12. Notably, a portion of the head band 12 as well as an entirety of the fastener 13 each is seated beneath the hair portion 11 and thereby not visible from an external line of sight directed to the hair portion 11.

In a non-limiting exemplary embodiment, the hair portion 11 includes an anterior section 15 and a posterior section 16 detachably engaged therewith.

In a non-limiting exemplary embodiment, the head band 12 includes a single and unitary elastic loop 21 connected to a front edge 22 of the posterior section 16.

In a non-limiting exemplary embodiment, the fastener 13 includes a comb 23 slidably affixed to a longitudinal length of the elastic loop 21. For example, the comb 23 may be slide along a tongue and groove guide, magnetic track, etc.

In a non-limiting exemplary embodiment, the comb 23 is removably engaged with the anterior section 15.

In a non-limiting exemplary embodiment, a distal edge 25 of the posterior section 16 folds up and over the head band 12 and the fastener 13, thereby extending downwardly away from the anterior section 15.

In a non-limiting exemplary embodiment, the head band 12 further includes a decorative overlay 24 positioned over an upper section of the elastic loop 21 as well as the comb 23 and the front edge 22 of the posterior section 16.

In a non-limiting exemplary embodiment, the distal edge 25 of the posterior section 16 is raised above and overlaps a rear edge 26 of the anterior section 15.

The present disclosure further includes a method of utilizing a hair extension for covering a bald region of a head of a user. Such a method includes the steps of: providing a wig 30 by performing a plurality of sub-steps including: providing a hair portion 11; providing and fixedly attaching a resilient head band 12 to the hair portion 11; providing and adjustably mating a fastener 13 to the head band 12; removably attaching the fastener 13 to the hair portion 11; seating a portion of the head band 12 as well as an entirety of the fastener 13 beneath the hair portion 11 such that each of the portion of the head band 12 as well as the entirety of the fastener 13 is not visible from an external line of sight directed to the hair portion 11; and positioning the wig 30 on the bald region of the head of the user.

Referring to the figures in general, in a non-limiting exemplary embodiment, the hair extension 10 is configured in the form of bangs, braids and traditional wefts, to be applied along the crown line and held in place via a lightweight and flexible head band 12, thus creating the appearance of a full, thick head of hair. The hair accessory 10 is designed expressly to discreetly blend with the wearer's own, natural hair. The actual head band 12 could be comprised of a breathable and flexible fabric material, or this head band 12 could be a solid, one piece unit manufactured of lightweight plastic or rubber. Fully adjustable, this oval shaped head band 12 would extend from the wearer's left ear, over the top of the head and down to the right year, with the adjustable length of the band measuring approximately 14 inches and the width of the unit measuring approximately 3 inches. The head band 12 could be configured to be undetectable and thus could be the same color and texture as the hair extension 10 and positioned below the attached hair piece, or could be configured as a standard head band 12 accessory, with the attached extension affixed to the underside of the band and the head band 12 itself designed to provide an attractive means of complimenting one's overall look.

In a non-limiting exemplary embodiment, the hair accessory 10 could be manufactured of synthetic or human hair, with the wefted extensions secured to the head band 12 in rows, thus creating a natural and smooth appearance. As mentioned, these wefts could be produced to mimic the appearance of bangs, while braided wefts and wefts of medium and long tresses could also be produced. These wefts would be produced in a wide range of shades designed to match the most popular hair colorants available on the market, as well as to match various shades natural hair coloring. Further, fun and funky versions of the hair accessory 10 produced in a variety of vibrant colors popularized by teens and young adults could also be made available.

Designed to perfectly blend with the wearer's natural hair, these unique hairpieces could be produced in fine, medium and thick versions, as well as in various textures such as straight, wavy and curly. Further, hair accessory 10 could be produced in ethnic versions, with wefts comprised of thick, black hair typical of Asian men and women, as well as in various textures African American hair. Braided wefts could be produced in a variety of diameters and styles, thus accommodating various popular braided hairstyles.

In a non-limiting exemplary embodiment, application and use of the hair accessory 10 solution would be very simple and straight forward. Consumers would simply purchase pieces from the hair accessory 10 line to complement their own, natural hair. For instance, a senior suffering minor hair loss brought on by menopause may purchase a curly hair accessory 10 extension to accommodate her curly silver locks. Alternately, a free spirited college coed might purchase an extension boasting short blond bangs accentuated with stripes of purple and pink hair colorant to provide a festive weekend look. Once purchased, the user would simply slide the hair accessory 10 over their head as if donning a traditional head band 12, making any necessary adjustments for a secure and comfortable fit. The user would then simply style the hair extension 10, blending the hair accessory 10 hair with her natural hair. With the hair accessory 10 properly applied, the extension could be styled along with the wearer's natural hair and the style could be set with a light spritz of finishing spray.

The hair accessory 10 is an innovative product which would offer consumers a number of significant benefits and advantages. For example, the hair accessory 10 would provide consumers who suffer thinning hair along the crown or part a simple means of creating the appearance of a full and thick head of hair. An easy to use extension conveniently affixed to a lightweight and comfortable head band 12, the hair accessory 10 would enable consumers to apply beautiful, realistic looking bangs, braids and extensions in areas where they may experience thinning or extensive hair loss. Further, those with high foreheads could also utilize the hair accessory 10 to create the illusion of a lower crown line.

Consumers should especially appreciate that hair accessory 10 extensions would be manufactured in a wide array of colors, as well as in various textures and styles. Allowing the wearer to perfectly match their hair piece to their own, natural hair or existing extensions, the hair accessory 10 would prove particularly well suited for those who have suffered hair loss or thinning brought on by medical treatments, illness or age. Providing the wearer the confidence and sense of pride associated with a full head of hair, the hair accessory 10 would enable children and adults who have suffered hair loss to truly put their best foot forward. Not limited to wear by those who have suffered hair loss, these unique extensions could provide a simple means of updating or alternating one's look. Enabling the wearer to try out a new style without making the permanent commitment associated with cutting, dying or perming their hair, the hair accessory 10 extension would provide a fun way to experiment and then revert to one's standard style if so desired.

Further, those who color their hair should appreciate that the hair accessory 10 extension would camouflage root growth, enabling them to extend the time between color treatments. Silky soft and easily cared for; the hair accessory 10 extension could be shampooed, styled and conditioned in the same manner as the wearer's own natural hair. Curled, flat ironed, crimped or braided, the hair accessory 10 would enable the wearer to enjoy a variety of hairstyles, with one simple hair piece. Effortlessly applied, the hair accessory 10 could be comfortably donned by those who suffer limited mobility brought on by arthritis and other medical maladies.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed is:

1. A hair extension for covering a bald region of a head of a user, said hair extension comprising: a wig including a hair portion;

a head band fixedly attached to said hair portion; and a fastener removably attached to said hair portion and adjustably mated to said head band;

wherein an entirety of said fastener is seated beneath said hair portion and thereby not visible from an external line of sight directed to said hair portion;

wherein said hair portion comprises: an anterior section and a posterior section detachably engaged therewith;

wherein said head band comprises: a single and unitary elastic loop connected to a front edge of said posterior section;

wherein said fastener comprises: a comb slidably affixed to a longitudinal length of said elastic loop;

wherein said comb is removably engaged with said anterior section;

wherein a distal edge of said posterior section folds up and over said head band and said fastener, thereby extending downwardly away from said anterior section;

wherein said head band further comprises: a decorative overlay positioned over an upper section of said elastic loop as well as said comb and said front edge of said posterior section;

wherein said distal edge of said posterior section is raised above and directly overlaps a rear edge of said anterior section;

wherein said anterior section includes hair and said posterior section includes hair directly engaged with said hair of said anterior section;

wherein said fastener is directly mated to said head band.

2. A hair extension for covering a bald region of a head of a user, said hair extension comprising: a wig including a hair portion;

a resilient head band fixedly attached to said hair portion; and a fastener removably attached to said hair portion and adjustably mated to said head band;

wherein a portion of said head bald as well as an entirety of said fastener each is seated beneath said hair portion and thereby not visible from an external line of sight directed to said hair portion;

wherein said portion comprising an anterior section and a posterior section detachably engaged therewith;

wherein said anterior section includes hair and said posterior section includes hair directly engaged with said hair of said anterior section;

wherein said fastener is directly mated to said head band;

wherein said head band comprises a single and unitary elastic loop connected to a front edge of the posterior section;

wherein said fastener comprises a comb slidably affixed to a longitudinal length of said elastic loop;

wherein said comb is removably engaged with said anterior section;

wherein a distal edge of said posterior section folds up and over said head band and said fastener, thereby extending downwardly away from said anterior section;

wherein said head band further comprises a decorative overlay positioned over an upper section of said elastic loop as well as said comb and said front edge of said posterior section;

wherein said distal edge of said posterior section is raised above and directly overlaps a rear edge of said anterior.

* * * * *